US011674192B2

(12) United States Patent
Zhang et al.

(10) Patent No.: US 11,674,192 B2
(45) Date of Patent: Jun. 13, 2023

(54) METHOD OF MAKING STEEL BY DEEPLY DEPHOSPHORIZATION IN HOT METAL TANK AND DECARBURIZATION USING SEMI-STEEL WITH NEARLY ZERO PHOSPHORUS LOAD IN CONVERTER

(71) Applicant: University of Science and Technology Beijing, Beijing (CN)

(72) Inventors: Yanling Zhang, Beijing (CN); Zheng Zhao, Beijing (CN); Weifeng Zhang, Beijing (CN); Zhonghua Zhan, Beijing (CN)

(73) Assignee: University of Science and Technology Beijing, Beijing (CN)

( * ) Notice: Subject to any disclaimer, the term of this patent is extended or adjusted under 35 U.S.C. 154(b) by 0 days.

(21) Appl. No.: 17/953,832

(22) Filed: Sep. 27, 2022

(65) Prior Publication Data

US 2023/0121123 A1 Apr. 20, 2023

(30) Foreign Application Priority Data

Oct. 19, 2021 (CN) ..... 202111215651.9

(51) Int. Cl.

| | |
|---|---|
| ***C21C 7/064*** | (2006.01) |
| ***C21C 7/068*** | (2006.01) |
| ***C21C 1/02*** | (2006.01) |

(52) U.S. Cl.

CPC ..... *C21C 7/0645* (2013.01); *C21C 1/025* (2013.01); *C21C 7/068* (2013.01)

(58) Field of Classification Search

CPC ..... C21C 7/0645; C21C 1/025; C21C 7/068

USPC ..... 75/507

See application file for complete search history.

(56) References Cited

FOREIGN PATENT DOCUMENTS

| | | | |
|---|---|---|---|
| CN | 1596316 A | | 3/2005 |
| CN | 106676233 A | * | 5/2017 |
| CN | 107849625 A | | 3/2018 |

(Continued)

OTHER PUBLICATIONS

JP-2002249814-A Translation (Year: 2002).*

(Continued)

*Primary Examiner* — Brian D Walck
*Assistant Examiner* — Danielle Carda
(74) *Attorney, Agent, or Firm* — Edell, Shapiro & Finnan, LLC

(57) ABSTRACT

A method of making steel by deeply dephosphorization in a hot metal tank and decarburization using semi-steel with nearly zero phosphorus load in a converter includes the following steps: putting an efficient dephosphorization agent into the hot metal tank in advance, and conducting dephosphorization during blast furnace tapping and transportation of blast furnace hot metal by the hot metal tank to obtain semi-steel with [P] less than 0.04 wt. % and [C] greater than or equal to 3.5 wt. %; and removing dephosphorization slag, and pouring the semi-steel into the converter for decarburization to obtain molten steel. The efficient dephosphorization agent includes iron oxide scale, lime, and composite calcium ferrite. According to the method, a phosphorus content of the blast furnace hot metal is reduced to be less than or equal to 0.04 wt. % through the efficient dephosphorization agent.

4 Claims, 2 Drawing Sheets

(56) References Cited

FOREIGN PATENT DOCUMENTS

JP 2002249814 A * 9/2002 ..... C21C 1/02

OTHER PUBLICATIONS

CN-106676233-A Translation (Year: 2017).*
Notification to Grant Patent Right for Invention in counterpart Chinese Application No. 202111215651.9, dated Mar. 22, 2022, 3 pages.
First Office Action in counterpart Chinese Application No. 202111215651.9, dated Feb. 18, 2022, 13 pages.

* cited by examiner

METHOD OF MAKING STEEL BY DEEPLY DEPHOSPHORIZATION IN HOT METAL TANK AND DECARBURIZATION USING SEMI-STEEL WITH NEARLY ZERO PHOSPHORUS LOAD IN CONVERTER

CROSS REFERENCE TO RELATED APPLICATION

This patent application claims the benefit and priority of Chinese Patent Application No. 202111215651.9, filed on Oct. 19, 2021, the disclosure of which is incorporated by reference herein in its entirety as part of the present application.

TECHNICAL FIELD

The present disclosure relates to the technical field of metallurgy, and in particular, a method of making steel by deeply dephosphorization in a hot metal tank and decarburization using semi-steel with nearly zero phosphorus load in a converter.

BACKGROUND ART

Phosphorus is a typical impurity element in molten steel, and dephosphorization is one of the basic operations of the steelmaking process. The traditional long-process steelmaking process usually includes two procedures: hot metal pretreatment and converter blowing. The pre-dephosphorization of hot metal refers to the dephosphorization operation carried out before the hot metal enters the converter, which mostly uses lime as the dephosphorization agent. However, due to the low dephosphorization efficiency caused by poor dynamic conditions, the phosphorus content of hot metal cannot meet the requirements of steel grades, hence part of the dephosphorization task is transferred to the converter steelmaking process. Therefore, the usual converter steelmaking includes two links of dephosphorization and decarburization, which has a long smelting cycle and large amount of slag. Since the last century, Japan has developed a multi-refining converter (MURC) process that one converter is used for dephosphorization, the semi-steel after dephosphorization enters another converter for decarburization, and the converter slag from the decarburization converter can be returned to the dephosphorization converter, which can effectively reduce slag emission. However, due to the blowing of the two converters, the smelting cycle is not shortened, and the production efficiency is relatively low. Similarly, there is also a double-slag converter steelmaking process. In order to achieve the dephosphorization effect, dephosphorization-slagging-decarburization operations are carried out in the converter, which also has the problem of long smelting cycle and low production efficiency. So far, there is no steelmaking process in which there is only one converter and only decarburization is carried out in the converter without dephosphorization burden.

SUMMARY

An objective of the present disclosure is to provide a method of making steel by deeply dephosphorization in a hot metal tank and decarburization using semi-steel with nearly zero phosphorus load in a converter. By virtue of an efficient dephosphorization effect of a dephosphorization agent, the dephosphorization operation is completed during blast furnace tapping and transportation of blast furnace hot metal by the hot metal tank. A dephosphorization rate reaches no less than 90%. Semi-steel with [P] less than 0.04 wt. % and [C] greater than or equal to 3.5 wt. % is obtained. The semi-steel is added to the converter only for decarburization and blowing to obtain molten steel with qualified compositions whose [P] and [C] contents meet the requirements of most steel grades ([P]<0.03%, and [C]<0.5%). The present disclosure obviously shortens the converter blowing time, improves the production efficiency, and reduces the amount of slag.

To achieve the above objective of the present disclosure, the present disclosure provides the following technical solutions:

The present disclosure provides a method of making steel by deeply dephosphorization in a hot metal tank and decarburization using semi-steel with nearly zero phosphorus load in a converter, including the following steps:

putting an efficient dephosphorization agent into the hot metal tank in advance, and conducting dephosphorization during blast furnace tapping and transportation of blast furnace hot metal by the hot metal tank to obtain semi-steel with [P] less than 0.04 wt. % and [C] greater than or equal to 3.5 wt. %; and removing dephosphorization slag, and pouring the semi-steel into the converter for decarburization to obtain molten steel, where the efficient dephosphorization agent includes iron oxide scale, lime, and composite calcium ferrite.

Preferably, taking a total mass of the efficient dephosphorization agent as 100%, in the efficient dephosphorization agent, the iron oxide scale may have a content of 55-65 wt. %, the lime may have a content of 10-20 wt. %, and the composite calcium ferrite may have a content of 20-30 wt. %.

Preferably, the composite calcium ferrite may include the following phases: $CaFe_2O_4$, $Ca_2Fe_2O_5$, and $Ca_2FeAlO_5$.

Preferably, the composite calcium ferrite may include the following compositions: 45-55 wt. % of $Fe_2O_3$, 20-25 wt. % of CaO, and 8-10 wt. % of $Al_2O_3$.

Preferably, a percentage of the efficient dephosphorization agent to the blast furnace hot metal may be 3-10 wt. %.

Preferably, the blast furnace hot metal may have a phosphorus content of 0.06-0.15 wt. %, and a carbon content of 4.0-4.5 wt. %.

Preferably, the dephosphorization may be conducted at 1,370-1,450° C. for 5-15 min.

Preferably, a slag-forming agent may be added during the decarburization. A percentage of the slag-forming agent to the semi-steel may be 1-3 wt. %.

Preferably, the slag-forming agent may include one or more selected from the group consisting of lime, sand and gravel, red mud balls, and dolomite.

The present disclosure provides the method of making steel by deeply dephosphorization in a hot metal tank and decarburization using semi-steel with nearly zero phosphorus load in a converter, including the following steps: putting an efficient dephosphorization agent into the hot metal tank in advance, and conducting dephosphorization during blast furnace tapping and transportation of blast furnace hot metal by the hot metal tank to obtain semi-steel with [P] less than 0.04 wt. % and [C] greater than or equal to 3.5 wt. %; and removing dephosphorization slag, and pouring the semi-steel into the converter for decarburization to obtain molten steel. The efficient dephosphorization agent includes iron oxide scale, lime, and composite calcium ferrite. According to the method, a phosphorus content ([P]) of the blast furnace hot metal is reduced to be less than or equal to 0.04 wt. % through the efficient dephosphorization agent, which meets the requirements of most steel grades for [P]. The semi-steel with a carbon content [C] greater than or equal to 3.5% is obtained, and is added to the converter only for decarburization and blowing. Compared with a traditional converter steelmaking process, the method shortens a converter smelting time by 3-5 min. Due to the extremely low phosphorus load in the converter decarburization process, high-carbon-catching steel tapping is easier to achieve at an end point, and the molten steel has a higher purity.

DETAILED DESCRIPTION OF THE EMBODIMENTS

The present disclosure provides a method of making steel by deeply dephosphorization in a hot metal tank and decarburization using semi-steel with nearly zero phosphorus load in a converter, including the following steps.

An efficient dephosphorization agent is put into the hot metal tank in advance, and dephosphorization is conducted during blast furnace tapping and transportation of blast furnace hot metal by the hot metal tank to obtain semi-steel with [P] less than 0.04 wt. % and [C] greater than or equal to 3.5 wt. %.

Dephosphorization slag is removed, and the semi-steel is poured into the converter for decarburization to obtain molten steel.

The efficient dephosphorization agent includes iron oxide scale, lime, and composite calcium ferrite.

Figure 1:
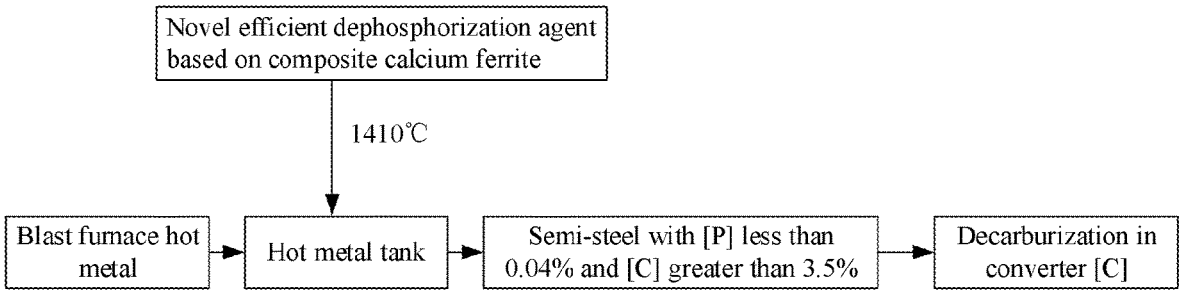
FIG. 1 is a flow chart of a process of making steel by deeply dephosphorization in a hot metal tank and decarburization using semi-steel with nearly zero phosphorus load in a converter provided by the present disclosure.

A flow chart of a process of making steel by deeply dephosphorization in a hot metal tank and decarburization using semi-steel with nearly zero phosphorus load in a converter provided by the present disclosure is shown in FIG. 1. The method for making steel of the present disclosure is described in detail in combination with FIG. 1.

In the present disclosure, the efficient dephosphorization agent is put into the hot metal tank in advance, and dephosphorization is conducted during blast furnace tapping and transportation of the blast furnace hot metal by the hot metal tank to obtain the semi-steel with [P] less than 0.04 wt. % and [C] greater than or equal to 3.5 wt. %. In the present disclosure, the blast furnace hot metal has a phosphorus content of preferably 0.06-0.15 wt. %, more preferably 0.10-0.15 wt. %, and a carbon content of preferably 4.0-4.5 wt. %.

In the present disclosure, the efficient dephosphorization agent includes iron oxide scale, lime, and composite calcium ferrite, and is preferably composed of iron oxide scale, lime, and composite calcium ferrite. In the present disclosure, taking a total mass of the efficient dephosphorization agent as 100%, the iron oxide scale has a content of preferably 55-65 wt. %, more preferably 60 wt. %, the lime has a content of preferably 10-20 wt. %, more preferably 14.4 wt. %, and the composite calcium ferrite has a content of preferably 20-30 wt. %, more preferably 25 wt. %.

In the present disclosure, the composite calcium ferrite preferably includes the following phases: $CaFe_2O_4$, $Ca_2Fe_2O_5$, and $Ca_2FeAlO_5$. In the present disclosure, the composite calcium ferrite includes the following specific compositions: 45-55 wt. % of $Fe_2O_3$, 20-25 wt. % of CaO, and 8-10 wt. % of $Al_2O_3$.

In the present disclosure, the composite calcium ferrite has a low melting point and the lime has high dissolution efficiency, creating excellent dynamic conditions for dephosphorization in the hot metal tank. Coupled with the excellent dephosphorization thermodynamic conditions of the blast furnace hot metal, the [P] of the blast furnace hot metal can be reduced from the initial 0.15 wt. % to be less than or equal to 0.04 wt. % within 8-10 min, and the dephosphorization efficiency can reach no less than 75%.

In the present disclosure, a percentage of the efficient dephosphorization agent to the blast furnace hot metal is preferably 3-10 wt. %, more preferably 5-7 wt. %.

In the present disclosure, the dephosphorization is conducted at preferably 1,370-1,450° C., more preferably 1,400-1,410° C., for preferably 10-20 min, more preferably 15-20 min.

In the present disclosure, the dephosphorization is conducted during blast furnace tapping and transportation of the blast furnace hot metal by the hot metal tank.

In the present disclosure, the semi-steel has a phosphorus content ([P]) preferably less than or equal to 0.04 wt. %, more preferably 0.035 wt. %, and a carbon content ([C]) preferably greater than or equal to 3.5 wt. %, more preferably 3.6 wt. %.

In the present disclosure, the dephosphorization slag in the hot metal tank is preferably removed to obtain the semi-steel.

After the semi-steel is obtained, the dephosphorization slag is removed, and the semi-steel is poured into the converter for decarburization to obtain the molten steel. In the present disclosure, a slag-forming agent is preferably added during the decarburization. In the present disclosure, a percentage of the slag-forming agent to the semi-steel is preferably 1-3 wt. %.

In the present disclosure, the slag-forming agent preferably includes one or more selected from the group consisting of lime, sand and gravel, red mud balls, and dolomite. In the present disclosure, the red mud ball preferably includes the following compositions: 40-65 wt. % of $Fe_2O_3$, 10-15 wt. % of $Al_2O_3$, 2-5 wt. % of $SiO_2$, and 1-2 wt. % of $Na_2O$.

In the present disclosure, the final slag has a binary basicity of preferably 2.5-2.8, more preferably 2.6-2.7. In the present disclosure, the final slag has an FeO content of preferably 12-18 wt. %, an $Al_2O_3$ content of preferably 5-12 wt. %, and an MgO content of preferably 6-8 wt. %.

In the present disclosure, the decarburization is preferably oxygen blowing decarburization. In the present disclosure, the decarburization is conducted at preferably 1,400-1,600° C., more preferably 1,500-1,600° C. In the present disclosure, during the decarburization, the oxygen blowing intensity is dynamically controlled according to the carbon content of the molten steel, and the oxygen blowing intensity is preferably 3-5 $Nm^3/(h \cdot t)$. In the present disclosure, the decarburization is conducted for preferably 10-20 min.

In the present disclosure, during transportation of the blast furnace hot metal by the hot metal tank, the [P] of the blast furnace hot metal is reduced from the initial 0.06-0.15 wt. % to be less than or equal to 0.04 wt. % by the efficient dephosphorization agent based on the composite calcium ferrite to obtain the semi-steel with [C] greater than or equal to 3.5 wt. %. The semi-steel is added to the converter only for decarburization and blowing to obtain qualified molten steel. Compared with the traditional steelmaking process, the method of the present disclosure is more compact, and can save the smelting time by 3-5 min.

The technical solutions in the present disclosure are clearly and completely described below in conjunction with examples of the present disclosure. It is clear that the described examples are merely a part, rather than all of the examples of the present disclosure. All other examples obtained by those of ordinary skill in the art based on the examples of the present disclosure without creative efforts shall fall within the protection scope of the present disclosure.

Example 1

2.23 kg of pig iron with an initial [P] content of 0.15 wt. % was taken for a dephosphorization test. A temperature was controlled at 1,410° C. 97 g of iron oxide scale, 23 g of lime, and 40 g of composite calcium ferrite were added to a furnace for dephosphorization for 15 min to obtain semi-steel.

2 kg of the semi-steel was subjected to a single decarburization test. An initial blowing temperature was 1,350° C. Slag-forming agents, 35 g of lime and 25 g of red mud, were added into the furnace in batches. After the slag-forming agents were completely melted, oxygen blowing was started at a flow rate controlled at 0.7 $m^3/h$ for decarburization for 20 min to obtain molten steel.

Example 2

This example was basically the same as Example 1, except that the dephosphorization time was adjusted from 15 min to 20 min.

Example 3

This example was basically the same as Example 1, except that the dephosphorization time was adjusted from 15 min to 10 min.

Comparative Example 1

This example was basically the same as Example 1, except that the dephosphorization time was adjusted from 15 min to 5 min.

Test Example 1

Figure 2:
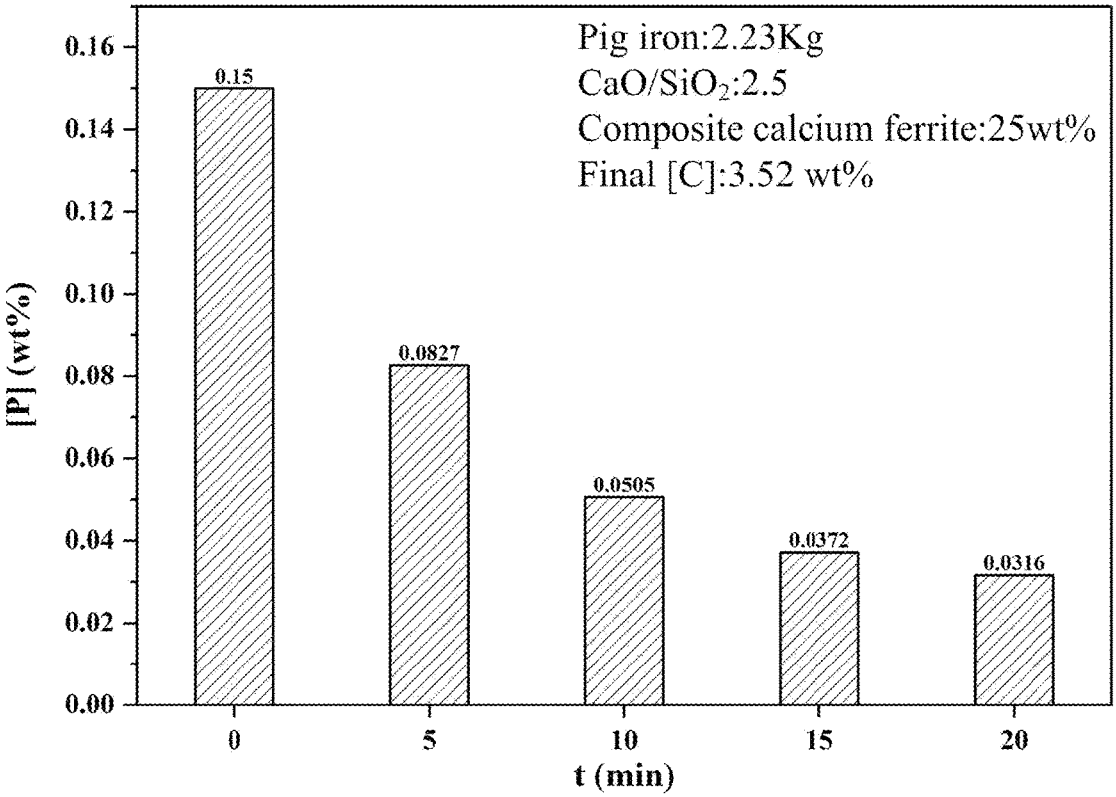
FIG. 2 is a graph showing [P] and [C] contents of semi-steel prepared in Examples 1 to 3 and Comparative Example 1.

[P] and [C] contents of semi-steel prepared in Examples 1 to 3 and Comparative Example 1 are shown in FIG. 2. It can be seen from FIG. 2 that after the basicity of the final slag is controlled at 2.5, and the composite calcium ferrite whose percentage in the efficient dephosphorization agent is 25 wt. % is added to the form slag, the [P] content can reach 0.0372 wt. % within 15 min, while the [C] content is still controlled at 3.5 wt. %. The method of the present disclosure can realize efficient dephosphorization and prepare the semi-steel with suitable compositions.

Comparative Example 2

This example was basically the same as Example 1, except that the decarburization time was adjusted from 20 min to 10 min.

Figure 3:
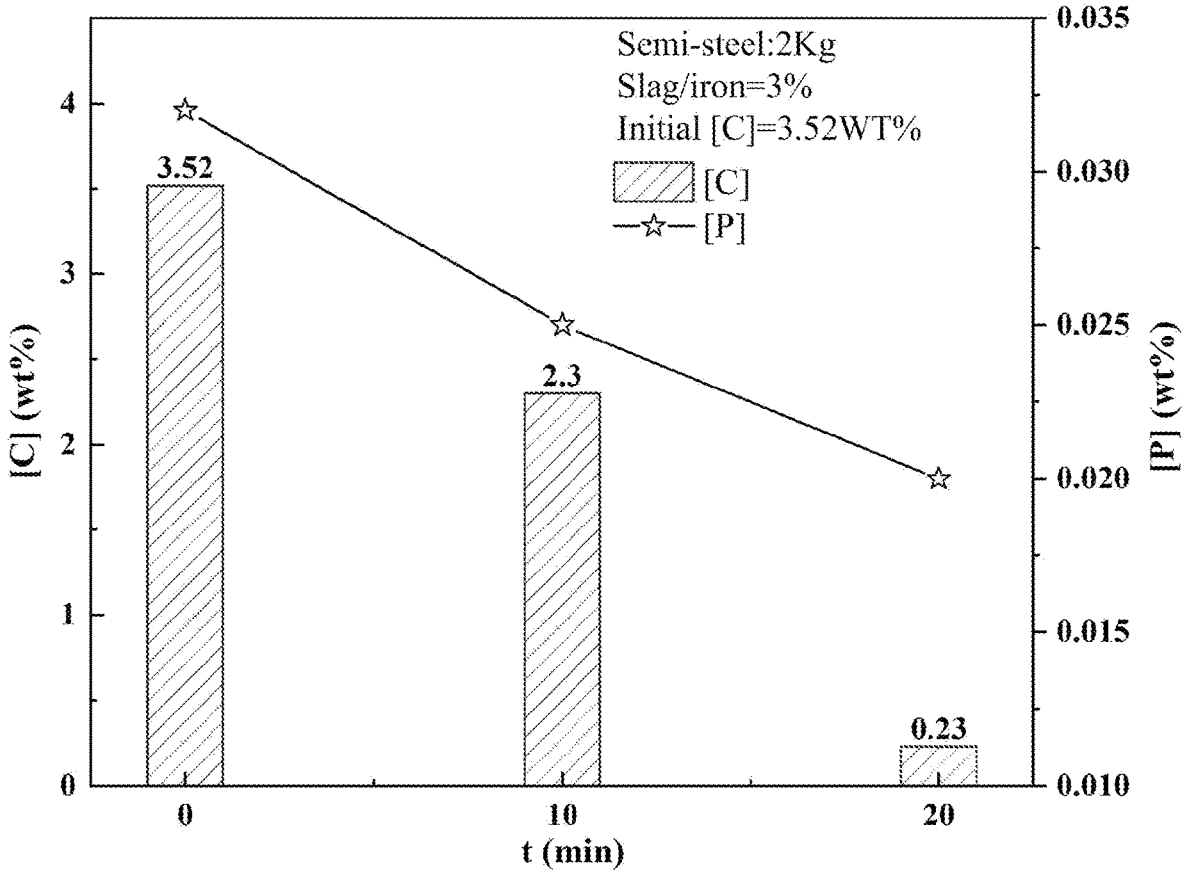
FIG. 3 is a graph showing a [C] content of molten steel prepared in Example 1 and Comparative Example 2.

A [C] content of molten steel prepared in Example 1 and Comparative Example 2 is shown in FIG. 3. It can be seen from FIG. 3 that in the case of oxygen blowing single decarburization, the molten steel has a [C] content of 0.23 wt. % at the end point of smelting, and the molten steel produced by smelting has a [P] content of 0.02 wt. %, which basically meets the requirements of all steel grades for the phosphorus content.

The above descriptions are merely preferred implementations of the present disclosure. It should be noted that those of ordinary skill in the art may further make several improvements and modifications without departing from the principle of the present disclosure, but such improvements and modifications should be deemed as falling within the protection scope of the present disclosure.

What is claimed is:

1. A method of making steel by deeply dephosphorization in a hot metal tank and decarburization using semi-steel with nearly zero phosphorus load in a converter, comprising the following steps:

putting an efficient dephosphorization agent into the hot metal tank in advance, and conducting dephosphorization during blast furnace tapping and transportation of blast furnace hot metal by the hot metal tank to obtain semi-steel with [P] less than 0.04 wt. % and [C] greater than or equal to 3.5 wt. %; and removing dephosphorization slag, and pouring the semi-steel into the converter for decarburization to obtain molten steel and a final slag, wherein:

taking a total mass of the efficient dephosphorization agent as 100%, the efficient dephosphorization agent comprises 55-65 wt. % iron oxide scale, 10-20 wt. % lime, and 20-30 wt. % composite calcium ferrite, in which the composite calcium ferrite further contains $Fe_2O_3$, CaO, and $Al_2O_3$;

the composite calcium ferrite comprises the following phases: $CaFe_2O_4$, $Ca2Fe_2O_5$, and $Ca_2FeAlO_5$;

a slag-forming agent is added during the decarburization; and a percentage of the slag-forming agent to the semi-steel is 1-3 wt. %;

the slag-forming agent comprises one or more selected from the group consisting of lime, sand and gravel, red mud balls, and dolomite; and the final slag has a binary basicity of 2.5-2.8; and the final slag has an FeO content of 12-18 wt. %, an $Al_2O_3$ content of 5-12 wt. %, and a MgO content of 6-8 wt. %.

2. The method of making steel according to claim 1, wherein a percentage of the efficient dephosphorization agent to the blast furnace hot metal is 3-10 wt. %.

3. The method of making steel according to claim 1, wherein the blast furnace hot metal has a phosphorus content of 0.06-0.15 wt. %, and a carbon content of 4.0-4.5 wt. %.

4. The method of making steel according to claim 1, wherein the dephosphorization is conducted at 1,370-1,450° C. for 5-15 min.

* * * * *